US010563135B2

(12) United States Patent
Fei et al.

(10) Patent No.: US 10,563,135 B2
(45) Date of Patent: Feb. 18, 2020

(54) PROCESS FOR PRODUCING A DIESEL FUEL BY OLIGOMERIZATION

(71) Applicant: UOP LLC, Des Plaines, IL (US)

(72) Inventors: Zhihao Fei, Naperville, IL (US); Steven L. Krupa, Fox River Grove, IL (US); Hosoo Lim, Mount Prospect, IL (US); Charles P. Luebke, Mount Prospect, IL (US); Robert Mehlberg, Wheaton, IL (US); Christopher P. Nicholas, Evanston, IL (US); Lisa M. Wolschlag, Aurora, IL (US)

(73) Assignee: UOP LLC, Des Plaines, IL (US)

( * ) Notice: Subject to any disclaimer, the term of this patent is extended or adjusted under 35 U.S.C. 154(b) by 7 days.

(21) Appl. No.: 15/341,525

(22) Filed: Nov. 2, 2016

(65) Prior Publication Data

US 2017/0240821 A1 Aug. 24, 2017

Related U.S. Application Data

(60) Provisional application No. 62/263,391, filed on Dec. 4, 2015.

(51) Int. Cl.
*C10G 50/00* (2006.01)
*C10L 1/08* (2006.01)

(52) U.S. Cl.
CPC ..... *C10G 50/00* (2013.01); *C10L 1/08* (2013.01); *C10G 2300/307* (2013.01); *C10G 2300/708* (2013.01); *C10G 2400/04* (2013.01); *C10L 2270/026* (2013.01); *C10L 2290/12* (2013.01)

(58) Field of Classification Search
CPC ..... C10G 50/00; C10G 2300/708; C10L 2290/12
USPC ..... 585/501, 502; 502/56
See application file for complete search history.

(56) References Cited

U.S. PATENT DOCUMENTS

| | | | |
|---|---|---|---|
| 6,846,965 | B1 | 1/2005 | Schulz et al. |
| 7,271,304 | B2 | 9/2007 | Du Toit |
| 7,611,678 | B2 | 11/2009 | Louret et al. |
| 7,741,526 | B2 | 6/2010 | Kuechler et al. |
| 8,115,042 | B2 | 2/2012 | Godsmark et al. |
| 8,598,396 | B2 | 12/2013 | Beadle et al. |
| 8,716,542 | B2 | 5/2014 | Brown et al. |

(Continued)

FOREIGN PATENT DOCUMENTS

| | | |
|---|---|---|
| EP | 2049256 | 4/2009 |

OTHER PUBLICATIONS

Merker, G.P. et. al. "Combustion Engines Development: Mixture Formation, Combustion, Emissions and Simulation", Springer-Verlag: Berlin (2012); pp. 124 and 125.*

(Continued)

*Primary Examiner* — Youngsul Jeong

(57) ABSTRACT

Processes for oligomerizing olefins to produce diesel. The oligomerization zone temperature is controlled to counteract catalyst deactivation caused by coking, by contaminants such as cyclo C5 and/or cyclo C6 hydrocarbons, or both. The temperature is increased in increments to ensure that that the oligomerization zone is producing product at a target product yield with a target product quality, which may be measured by a product cetane number. The target product yield is at least 50 wt % and a target product cetane number may be at least 35.

18 Claims, 6 Drawing Sheets

(56) References Cited

U.S. PATENT DOCUMENTS

| | | | | |
|---|---|---|---|---|
| 2006/0199987 | A1* | 9/2006 | Kuechler | C07C 2/12 585/502 |
| 2008/0029435 | A1 | 2/2008 | Umansky et al. | |
| 2011/0124827 | A1* | 5/2011 | Godsmark | C07C 2/12 526/64 |
| 2014/0135547 | A1* | 5/2014 | Nicholas | C10G 50/00 585/315 |
| 2014/0135552 | A1 | 5/2014 | Nicholas et al. | |

OTHER PUBLICATIONS

Li et al., "Oligomerization of 1-decene: Catalyzation by immobilized AlCl3/γ-Al2O3 catalyst in fixed-bed reactor", China Petroleum Processing and Petrochemical Technology (2014), v 16, n 3, p. 50-55.

* cited by examiner

PROCESS FOR PRODUCING A DIESEL FUEL BY OLIGOMERIZATION

CROSS-REFERENCE TO RELATED APPLICATION

This application claims priority from Provisional Application No. 62/263,391 filed Dec. 4, 2015, the contents of which are hereby incorporated by reference

TECHNICAL FIELD

The present invention relates generally to the production of a diesel fuel from the oligomerization of light olefins to heavier oligomers, and more particularly to processes for controlling the oligomerization zone to counteract deactivation of the oligomerization catalyst.

BACKGROUND OF THE PRESENT INVENTION

Light olefin oligomerization is a process that can perform the conversion of C4 and C5 olefins into more desirable products. More specifically, it can convert light olefins into a diesel range product, or distillate. However, depending on the catalyst, the product from the oligomerization may have very poor diesel quality. For example, the olefinic distillate made by oligomerization process using an amorphous silico alumina ("ASA") catalyst typically has a very low cetane number (i.e., around 30 or less).

Other catalyst types have been utilized to convert C4 and C5 olefins into an olefinic distillate product having a desirable or target cetane number. The olefinic distillate product, which may also be hydrotreated, is a liquid fuel which can be directly used for diesel blending component. One such catalyst that has been more recently suggested for use in light olefin oligomerization is the MTT catalyst. However, while the MTT catalyst can perform the oligomerization reaction, deactivation must be counteracted.

Accordingly, there is an ongoing need or desire to provide processes for converting C4 and C5 olefins into an olefinic distillate product which address or counteract the deactivation of the catalyst from coke formation, impurities, and contaminants while still achieving a target distillate yield with a target product quality.

SUMMARY OF THE INVENTION

Various processes have been invented for operating an oligomerization zone with a gradual reactor temperature increase which can achieve a target product distillate yield, for example, greater than 50 wt % feed light olefins, and target product quality with, for example, a cetane number greater than 38. With a gradual temperature increase, the production of byproducts will be minimized since the catalyst is already partially deactivated when it reaches higher temperature.

In a first aspect, the present invention may be broadly characterized as providing a process for producing a hydrocarbon fuel product by: operating an oligomerization reaction zone to achieve a diesel range product at a target product distillate yield with a target product cetane number of 35, wherein the oligomerization zone receives an oligomerization feed stream comprising at least C4 and C5 olefins and includes a catalyst with a ten-membered ring pore structure and is configured to selectively oligomerize the olefins and provide an oligomerized effluent rich in diesel range hydrocarbons; deactivating the catalyst by coking, by exposing the catalyst to contaminants or including at least cyclo C5 hydrocarbons, or a combination thereof to a predetermined degree such that a product distillate yield of the oligomerization reaction zone is reduced at least 2% less than the target product distillate yield; increasing the peak bed temperature of the oligomerization reaction zone in response to the deactivation of the catalyst to the predetermined degree in order to achieve both the target product distillate yield and the target product cetane number; and regenerating the catalyst after the peak bed temperature of the oligomerization reaction zone has been increased if the target product distillate yield and the target product cetane number are not achieved.

The peak bed temperature of the oligomerization reaction zone may be repeatedly increased as long as the oligomerization reaction zone is operated to achieve the target product cetane number of at least 35.

According to preferred embodiments, the oligomerization reaction zone may be initially operated with a peak bed temperature of from approximately 210 to 230° C., or at least 210° C. It is contemplated that the temperature of the oligomerization reaction is increased in increments based upon a feed rate to the oligomerization zone. It is also contemplated that the increments are from 0 to 10° C. per day.

According to certain preferred embodiments, the target product distillate yield is greater than at least 50 wt % of feed light olefins. It is also contemplated that the target product distillate yield is greater than at least 65 wt % feed light olefins.

According to certain preferred embodiments, the target product cetane number is 38. It is also contemplated that the target product cetane number is 40.

According to certain preferred embodiments, the oligomerization reaction zone has been operated for a time of at least 100 hours and wherein the oligomerized effluent comprises less than 12 wt % aromatics.

According to preferred aspects, the process also may include monitoring a distillate product yield level in the oligomerized effluent to determine if the oligomerization reaction zone is achieving the target distillate product yield, and monitoring a cetane number of a portion of the oligomerized effluent to determine if the oligomerization reaction zone is achieving the target product cetane number.

According to preferred aspects, the process also may include reducing a feed rate of the oligomerization feed stream in response to the deactivation of the catalyst to the predetermined degree by at least the cyclo C5 hydrocarbons.

According to certain preferred aspects, the process also may include combining a portion of the oligomerized effluent with the oligomerization feed stream.

In a particularly preferred aspect, the present invention may be broadly characterized as providing a process for producing a hydrocarbon fuel product by: separating a cracked effluent stream into at least an oligomerization feed stream comprising at least C4 and C5 olefins, wherein the stream includes one or more of sulfur contaminants, cyclo C5 hydrocarbons, or, nitriles; passing the oligomerization feed stream to an oligomerization reaction zone, the oligomerization reaction zone including a catalyst with a ten-membered ring pore structure configured to selectively oligomerize the olefins and provide an oligomerized effluent being rich in diesel range hydrocarbons, wherein a peak bed temperature of the oligomerization reaction zone is initially approximately at least 210° C. when the oligomerization feed stream is passed into the oligomerization reaction zone;

and, increasing the peak bed temperature of the oligomerization reaction zone to achieve a target distillate product yield level of at least 50 wt % of feed light olefins and a target product cetane number of at least 35.

According to preferred embodiments, the peak bed temperature is increased in increments based upon a feed rate into the oligomerization zone and wherein a feed rate of the oligomerization feed stream is from approximately 0.1 to 1.5 WHSV. It is contemplated that the increments are from 0 to 10° C. per day.

According to certain preferred embodiments, the target distillate product yield level is at least approximately 65 wt % of feed light olefins.

According to preferred embodiments, the target product cetane number is at least 38. It is contemplated that the target product cetane number is at least 40.

According to preferred aspects, the process also may include combining a portion of the oligomerized effluent with the oligomerization feed stream.

According to preferred aspects, the process also may include monitoring a distillate product yield level in the oligomerized effluent to determine if the oligomerization reaction zone is achieving the target distillate product yield level, monitoring a cetane number of a portion of the oligomerized effluent to determine if the oligomerization reaction zone is achieving the target product cetane number, and, increasing the temperature of the oligomerization reaction zone if the distillate product yield level is below the target distillate product yield level and if the product cetane number is above the target cetane number.

According to certain preferred aspects, the process also may include counteracting a deactivation of the catalyst from at least cyclo C5/C6 hydrocarbons by gradually increasing the temperature of the oligomerization reaction zone.

In another aspect of the present invention, the present invention may be generally characterized as providing a process for producing a hydrocarbon fuel product by: passing a portion of a cracked effluent stream to a purification unit configured to provide an oligomerization feed stream comprising at least C4 and C5 olefins and one or more of sulfur contaminants, cyclo C5 hydrocarbons, and, nitriles; passing the oligomerization feed stream to a first reactor in an oligomerization reaction zone, the oligomerization reaction zone comprising at least one reactor, each including a catalyst with a ten-membered ring pore structure configured to selectively oligomerize the olefins and provide an oligomerized effluent being rich in diesel range hydrocarbons; measuring a distillate product yield level of the oligomerized effluent from the first reactor in the oligomerization reaction zone to determine if the first reactor in the oligomerization reaction zone is achieving a target product yield level comprising at least 50 wt % of feed light olefins; measuring a cetane number of a portion of the oligomerized effluent from the first reactor in the oligomerization reaction zone to determine if the first reactor in the oligomerization reaction zone is achieving a target cetane number comprising at least 35; increasing a peak bed temperature of the first reactor in the oligomerization reaction zone if the distillate product yield level of the oligomerized effluent from the first reactor in the oligomerization reaction zone is below the target product yield level and if the cetane number of the portion of the oligomerized effluent from the first reactor in the oligomerization reaction zone is above the target cetane number; removing the first reactor in the oligomerization reaction zone from service if first reactor in the oligomerization reaction zone is not achieving both the target product yield level and the target cetane number; and, regenerating the catalyst in the first reactor after the first reactor has been removed from service.

According to certain preferred aspects, the process also may include: passing the oligomerization feed stream to a second reactor in the oligomerization reaction zone; measuring a distillate product yield level in the oligomerized effluent from the second reactor in the oligomerization reaction zone to determine if the second reactor in the oligomerization reaction zone is achieving a target product yield level comprising at least 50 wt % of feed light olefins; measuring a cetane number of a portion of the oligomerized effluent from the second reactor in the oligomerization reaction zone to determine if the second reactor in the oligomerization reaction zone is achieving a target cetane number comprising at least 35; and, increasing a peak bed temperature of the second reactor in the oligomerization reaction zone if the distillate product yield level of the oligomerized effluent from the second reactor in the oligomerization reaction zone is below the target product yield level and if the cetane number of the portion of the oligomerized effluent from the second reactor in the oligomerization reaction zone is above the target cetane number.

Additional aspects, embodiments, and details of the invention, all of which may be combinable in any manner, are set forth in the following detailed description of the invention.

BRIEF DESCRIPTION OF THE DRAWINGS

One or more exemplary embodiments of the present invention will be described below in conjunction with the following drawing figures, in which.

DEFINITIONS

Figure 1:
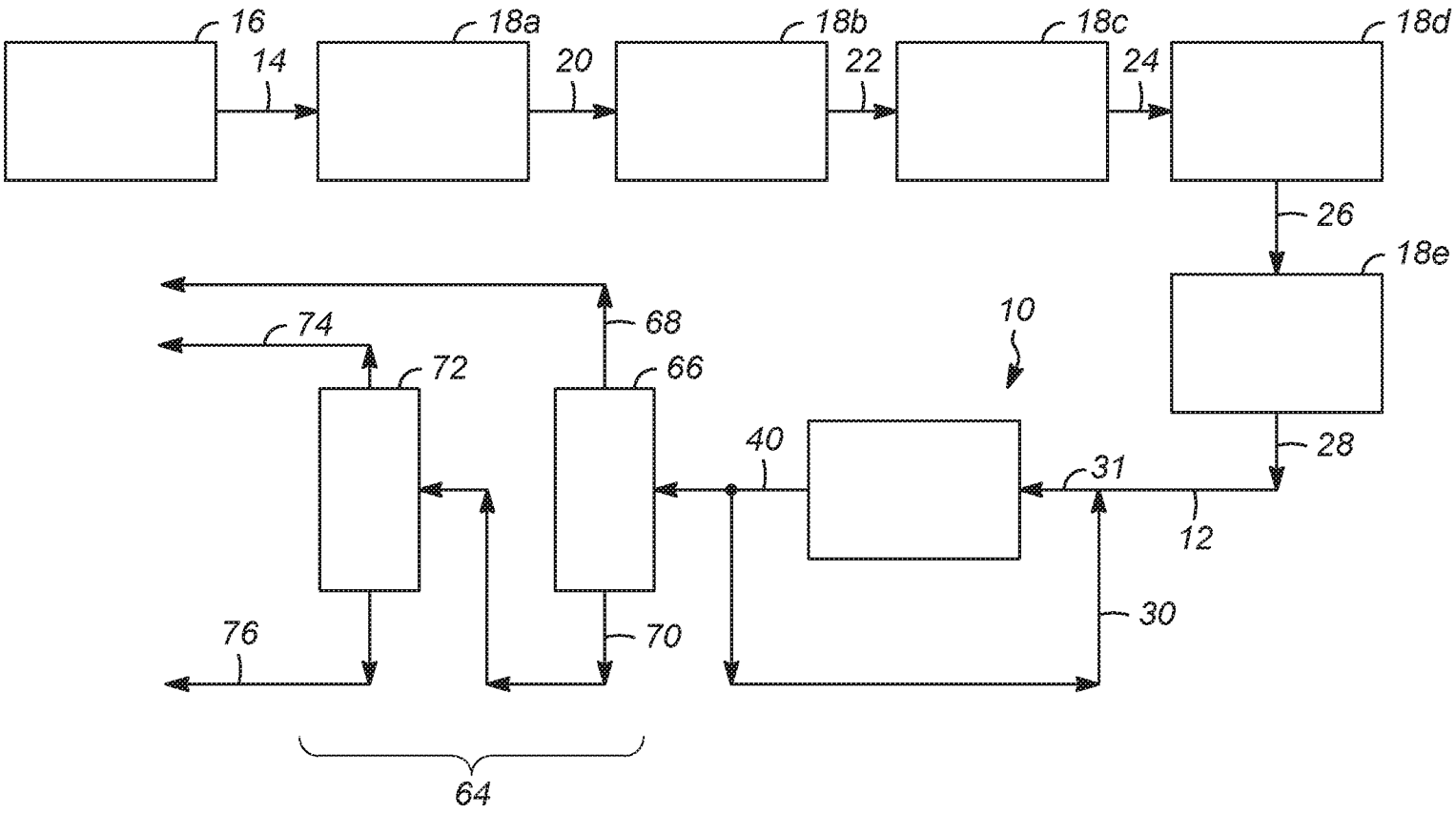
FIG. 1 shows a process flow diagram according to one or more embodiments of the present invention.

As used herein, the term "stream" can include various hydrocarbon molecules and other substances. Moreover, the term "stream comprising Cx hydrocarbons" or "stream comprising Cx olefins" can include a stream comprising hydrocarbon or olefin molecules, respectively, with "x" number of carbon atoms, suitably a stream with a majority of hydrocarbons or olefins, respectively, with "x" number of carbon atoms and preferably a stream with at least 75 wt % hydrocarbons or olefin molecules, respectively, with "x" number of carbon atoms. Moreover, the term "stream comprising Cx+ hydrocarbons" or "stream comprising Cx+ olefins" can include a stream comprising a majority of hydrocarbon or olefin molecules, respectively, with more than or equal to "x" carbon atoms and suitably less than 10 wt % and preferably less than 1 wt % hydrocarbon or olefin molecules, respectively, with x−1 carbon atoms. Lastly, the term "Cx− stream" can include a stream comprising a majority of hydrocarbon or olefin molecules, respectively, with less than or equal to "x" carbon atoms and suitably less than 10 wt % and preferably less than 1 wt % hydrocarbon or olefin molecules, respectively, with x+1 carbon atoms.

As used herein, the term "zone" can refer to an area including one or more equipment items and/or one or more sub-zones. Equipment items can include one or more reactors or reactor vessels, heaters, exchangers, pipes, pumps, compressors, controllers and columns. Additionally, an equipment item, such as a reactor, dryer, or vessel, can further include one or more zones or sub-zones.

As used herein, the term "substantially" can mean an amount of at least generally approximately 70%, preferably approximately 80%, and optimally approximately 90%, by weight, of a compound or class of compounds in a stream.

As used herein, the terms "T10" or "T90", unless otherwise noted, mean the temperature at which 10 volume percent or 95 volume percent, as the case may be, respectively, of the sample boils using ASTM D-86.

As used herein, the term "gasoline" includes hydrocarbons having a T10 boiling point temperature of approximately 70° C. (158° F.) and a T90 boiling point temperature of approximately 190° C. (374° F.).

As used herein, the term "diesel" or "distillate" includes hydrocarbons having a T90 boiling point temperature of approximately 338° C. (640.4° F.) and with an initial boiling point in the range of approximately 150 to approximately 200° C. (302 to 392° F.).

As used herein, the term "vacuum gas oil" (VGO) includes hydrocarbons having an initial boiling point above approximately 343° C. (650° F.), with a T10 boiling point temperature using ASTM D1160 of approximately 370° C. (698° F.) and a T90 boiling point temperature using ASTM D1160 of approximately 500° C. (932° F.).

As used herein, the term "vapor" can mean a gas or a dispersion that may include or consist of one or more hydrocarbons.

As used herein, the term "overhead stream" can mean a stream withdrawn at or near a top of a vessel, such as a column.

As used herein, the term "bottom stream" can mean a stream withdrawn at or near a bottom of a vessel, such as a column.

As depicted, process flow lines in the figures can be referred to interchangeably as, e.g., lines, pipes, feeds, gases, products, discharges, parts, portions, or streams.

As used herein, "bypassing" with respect to a vessel or zone means that a stream does not pass through the zone or vessel bypassed although it may pass through a vessel or zone that is not designated as bypassed.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column.

As used herein, and unless otherwise mentioned, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures".

As used herein, "taking a stream from" means that some or all of the original stream is taken.

As used herein, "light olefins" means C3 to C6 olefins, preferably C4 and C5 olefins.

As used herein, the term "distillate yield" and variants thereof refers to the conversion of the light olefins to heavier olefins, preferably diesel, in the oligomerization zone and may be reflected in terms of weight percent of the feed light olefins. For example, a "target product distillate yield of at least 65+ wt % of feed light olefins" means that at least 65 wt % of the light olefins in the feed (recycle and fresh) are converted into the specified heavier olefins in the oligomerization zone.

DETAILED DESCRIPTION

The present invention provides various processes for operating an oligomerization zone with a peak bed temperature from approximately 210 to approximately 230° C. (410 to 446° F.) and gradually increasing the temperature to counteract the deactivation of the catalyst and achieve both a target conversion of feed light olefins and a target yield. When the target conversion and target yield cannot be achieved, the operation of the oligomerization zone may be ceased. It is contemplated that the end of cycle temperature is expected to be greater than 260° C. (500° F.), or greater than 280° C. (536° F.). This dynamic temperature control may, in some instances, utilize the reactor delta T (outlet temperature less inlet temperature) in combination with an on-line gas chromatography to determine the conversion. In addition, the net yields of the gasoline and diesel yields may be utilized to determine temperatures in the reactor. As deactivation of the catalyst proceeds, the reactor exotherm will lower and olefins in the effluent will increase. The peak reactor temperature may be controlled by feed temperature, recycle rate, fresh feed rate, or a combination thereof. For example, increasing the feed temperature increases reaction rates and the associated exotherm will restore the conversion decrease by deactivation. Additionally, the exotherm and peak temperature will increase as fresh feed or recycle rates decrease. In an adiabatic reactor, the peak temperature will be at the reactor effluent. In a heat transfer reactor, the peak temperature may be in a catalyst bed or at a heat transfer tube.

Generally, in one or more aspects of the present invention, an oligomerization reaction zone is operated with a gradually increasing peak bed temperature starting from, for example, at least 210° C. (410° F.) and increasing in response to the catalyst deactivation from at least cyclo C5 and/or cyclo C6 hydrocarbons and/or other feed contaminants to maintain a target olefin conversion, oligomer product species distribution, yield, and product quality. The temperature increase can be controlled to maintain the target olefin conversion and distillate yield, with increments, for example, from 0 to 10° C. (0 to 18° F.) per day (depending on if the temperature increase is required). The incremental temperature increase may be dependent upon process variables, such as the feed rate (i.e., weigh hour space velocity (WHSV)). For example, for 0.4 WHSV fresh feed based, or 1 WHSV combined with a recycle stream, with a target product distillate yield of 65+ wt % feed light olefins, the incremental increase is preferably approximately 3° C. (5.4° F.)/day or between 0 of 5° C. (0 to 9° F.)/per day (depending on if the temperature increase is required based upon the yields and cetane number). The temperature can be adjusted based on on-line analysis of the reaction products to maintain the target product distillate yield of at least 65+ wt % of feed light olefins with a target product cetane number of at least 35 (which may be determined via ASTM D-613 (ISO 5165)). In various embodiments of the present invention, depending the particular requirements of the refinery, the target product distillate yield can be at least 10 wt %, or at least 20 wt %, or at least 25 wt %, or at least 30 wt %, or at least 35 wt %, or at least 40 wt %, or at least 45 wt %, or at least 50 wt %, or at least 55 wt %, or at least 50 wt %, or at least 65 wt %, or at least 70 wt %, or at least 75 wt %, or greater than 75 wt % of feed light olefins.

By increasing the temperature in a controlled manner, the reactor operation severity may be controlled at a relatively constant level. Product yield and product quality may be maintained to achieve the target as the catalyst deactivates and becomes less effective for oligomerization. Typically, this is achieved by increasing reactor temperature over time so a sufficient catalytic reaction rate is maintained. As a result, the reactor operation cycle time can be extended and the byproduct reactions can be minimized. It is contemplated, but not required, that the oligomerization zone is associated with an FCC unit producing a stream including C4 and C5 olefins.

Many configurations of the present invention are possible, but specific embodiments are presented herein by way of example. All other possible embodiments for carrying out the present invention are considered within the scope of the present invention. For example, the present invention may be implemented in any oligomerization zone with feedstock from any upstream process that produces light olefins.

With these general principles in mind, one or more embodiments of the present invention will be described with the understanding that the following description is not intended to be limiting.

With reference to FIG. 1, the various embodiments of the present invention relate to operating an oligomerization zone 10. The oligomerization zone 10 receives an oligomerization feed stream 12 comprising at least C4 and C5 olefins, and which may further include C3 to C6 paraffinic and olefinic hydrocarbons. The oligomerization feed stream 12 may comprise C4 hydrocarbons such as butenes, i.e., C4 olefins, and butanes. Butenes include normal butenes and isobutene. The oligomerization feed stream 12 may comprise C5 hydrocarbons such as pentenes, i.e., C5 olefins, and pentanes. Pentenes include normal pentenes and isopentenes. Typically, the oligomerization feed stream 12 may comprise at least 20 wt %, or at least 30 wt %, or at least 40 wt %, or at least 50 wt %, or at least 60 wt %, or at least 70 wt % fresh feed light olefins.

The oligomerization feed stream 12 typically comprises at least a portion of an effluent stream 14 from a reaction zone 16. In one or more embodiments, the reaction zone 16 comprises a fluid catalytic cracking (FCC) zone.

An FCC zone, as is known, receives a conventional FCC feedstock such as vacuum gas oil, a heavy bottom from crude oil, heavy bitumen crude oil, shale oil, tar sand extract, deasphalted residue, products from coal liquefaction, atmospheric and vacuum reduced crudes and/or mixtures thereof. The FCC feedstock is passed to a reactor that may include a riser that also receives a catalyst suspended in a stream of fluidization medium. Upon contacting the hydrocarbon feed with catalyst in the reactor, the heavier hydrocarbons in the FCC feedstock crack to produce lighter gaseous cracked products while coke is deposited on the catalyst particles to produce spent catalyst. The catalyst and gaseous product hydrocarbons are separated, with the catalyst being passed to a regenerator in which coke on the catalyst may be combusted, and the regenerated catalyst may be passed back to the reactor. The gaseous product hydrocarbons may be passed to an FCC product recovery zone. An exemplary FCC zone is described in detail in U.S. Pub. No. 2014/0135552, the entirety of which is incorporated herein by reference.

The FCC product recovery zone typically includes a main fractionation column and a gas recovery section. The FCC product recovery zone can include many fractionation columns and other separation equipment. The FCC recovery zone can recover a propylene product stream, a gasoline stream, a light olefin stream, and an LCO stream among others from the gaseous product hydrocarbons. The light olefin stream typically comprises C4 hydrocarbons including C4 olefins and perhaps having C5 hydrocarbons including C5 olefins and may be used as the oligomerization feed stream 12.

Generally, FCC processing conditions may include a temperature from approximately 400 to approximately 600° C. (752 to 1112° F.) and a pressure from approximately 69 to approximately 517 kPa (gauge) (10 to 75 psig) but typically less than approximately 275 kPa (gauge) (40 psig). The FCC catalyst may include a mixture, namely a first FCC catalyst, and a second FCC catalyst. Such a catalyst mixture is disclosed in, e.g., U.S. Pat. No. 7,312,370 B2. The first FCC catalyst may include any of the well-known catalysts that are used in the art of FCC. Preferably, the first FCC catalyst includes a large pore zeolite, such as a Y-type zeolite, an active alumina material, a binder material, including either silica or alumina, and an inert filler such as kaolin. The second FCC catalyst may include a medium or smaller pore zeolite catalyst, such as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second FCC catalyst has the medium or smaller pore zeolite dispersed on a matrix including a binder material such as silica or alumina and an inert filler material such as kaolin.

The FCC process typically produces a significant quantity of light olefins. For example, the total yield of C4 and C5 olefins from an FCC unit can be 15 wt % or more of the fresh feed. An FCC C4 and C5 stream typically includes approximately 60 wt % light olefins and the C5/C4 olefin ratio may be around 0.4. However, since some refineries already partially use these light olefins, the light olefin concentration and ratio can change in a wide range. The C4 and C5 olefins are typically lower value products and there is often a desire to convert, via, for example, oligomerization, these light olefins into more desired product like diesel.

However, the FCC C4 and C5 streams, particularly the C5 stream contains many contaminants and/or inhibitors (collectively referred to as contaminants) that may affect the performance of the oligomerization catalyst. The contaminants include light sulfur compounds (such as dimethyl sulfide (DMS), dimethyl disulfide (DMDS), diethyl disulfide (DEDS), etc,), oxygenates, and nitriles (such as acetonitrile and propionitrile), as well as other nitrogen species, such as alkanolamines or other basic nitrogen compounds. Many of these contaminants are removed or reduced in various pretreatments steps, however it may not be feasible to completely remove or reduce all of these contaminants. For example, after feed pretreatment, the level of sulfur compounds in the feed stream is typically at a ppm level.

Additionally, the FCC C4 and C5 streams typically also include cyclo-C5/C6 hydrocarbons (including, for example, cyclopentane, cyclopentene, benzene, cyclohexane, cyclohexene, and alkyl cyclopentanes, etc.). Experimental results shows that cyclopentane and cyclopentene may significantly reduce the activity of the catalyst when the peak bed temperature of the oligomerization zone is less than 220° C. Although not intending to be bound by any theory, it is believed that these compounds may block the access of MTT internal channels. Generally, pretreatment cannot remove these cyclic components from the feed stream. Accordingly, the feed stream to the oligomerization zone may still include some level of contaminants, such as sulfur compounds, that cannot be efficiently removed via pretreatment.

Again, as mentioned above, the reaction zone 16 may comprise any reaction zone, and the description of the FCC zone is not intended to be limiting, but rather merely exemplary. For example, instead of an FCC zone, the reaction zone 16 may comprise a steam cracking reaction zone, or a catalytic dehydrogenation zone. One of ordinary skill in the art will appreciate that any number of known processes may be utilized in the reaction zone 16 for providing the oligomerization feed stream 12.

Returning to FIG. 1, before the oligomerization feed stream 12 can be fed to the oligomerization zone 10, the oligomerization feed stream 12 typically requires purification. As discussed above, many impurities in the oligomerization feed stream 12 can poison or otherwise reduce the activity of an oligomerization catalyst. Sulfur containing compounds, oxygenates, and nitriles can harm oligomerization catalyst. Acetylene and diolefins can polymerize and produce gums on the catalyst or equipment. Consequently, the oligomerization feed stream 12 may be purified in one or more purification units 18*a*, 18*b*, 18*c*, 18*d*, 18*e*.

For example, a first purification unit 18*a* may comprise a mercaptan extraction unit which may be utilized to reduce the mercaptans in the oligomerization feed stream 12 to lower concentrations and provide a stream 20 lean in mercaptans. In the mercaptan extraction unit, a feed may first enter a prewash vessel containing aqueous alkali solution to remove hydrogen sulfide ($H_2S$), followed by a mercaptan extraction zone using a more concentrated caustic solution. This unit may also include a carbonyl sulfide (COS) removal step using a selective solvent, or alternatively, use an adsorptive bed to remove carbonyl sulfide. The details of this are well known to one skilled in the art. An example exemplary mercaptan removal unit is described in U.S. Pat. Nos. 7,326,333 and 8,597,501.

A second purification unit 18*b*, may comprise a selective hydrogenation unit which may be utilized to minimize diolefins and acetylenes in the oligomerization feed stream 12 and provide a stream 22 lean in diolefins and acetylenes. The diolefins and acetylenes have a tendency to polymerize and gum in the oligomerization zone 10 which can foul process equipment and negatively impact catalyst performance. Therefore, it is desirable to convert diolefins and acetylenes in the selective hydrogenation unit.

As is known, the selective hydrogenation unit receives a hydrogen gas and includes a catalyst. The selective hydrogenation catalyst can comprise an alumina support material preferably having a total surface area greater than 150 $m^2/g$, with most of the total pore volume of the catalyst provided by pores with average diameters of greater than 600 angstroms, and containing surface deposits of approximately 1.0 to 25.0 wt % nickel and approximately 0.1 to 1.0 wt % sulfur such as disclosed in U.S. Pat. No. 4,695,560. Spheres having a diameter from approximately 0.4 to 6.4 mm (1/64 and 1/4 inch) can be made by oil dropping a gelled alumina sol. The alumina sol may be formed by digesting aluminum metal with an aqueous solution of approximately 12 wt % hydrogen chloride to produce an aluminum chloride sol. The nickel component may be added to the catalyst during the sphere formation or by immersing calcined alumina spheres in an aqueous solution of a nickel compound followed by drying, calcining, purging and reducing. The nickel containing alumina spheres may then be sulfided. A palladium catalyst may also be used as the selective hydrogenation catalyst.

The selective hydrogenation process is normally performed at relatively mild hydrogenation conditions. These conditions will normally result in the hydrocarbons being present as liquid phase materials. The reactants will normally be maintained under the minimum pressure sufficient to maintain the reactants as liquid phase hydrocarbons which allow the hydrogen to dissolve into the light olefin feed. A broad range of suitable operating pressures may be used. For example, the pressure in the selective hydrogenation unit may be from approximately 276 to approximately 5,516 kPa gauge (40 to 800 psig). The temperature of the selective hydrogenation unit may from approximately 25 to approximately 250° C. (77 to 482° F.). The liquid hourly space velocity of the reactants through the selective hydrogenation catalyst should be above 1.0 $hr^{-1}$, for example from approximately 5.0 to approximately 35.0 $hr^{-1}$. The molar ratio of hydrogen to diolefinic hydrocarbons should generally be maintained from 1.0 to 2.0. These operating conditions are merely exemplary.

A third purification unit 18*c* may comprise a sodium bisulfite wash unit which may be utilized to remove oxygenates such as aldehydes and ketones from the oligomerization feed stream 12 and provide a treated stream 24. The sodium bisulfite wash unit can be desirable as it may reduce the load of aldehydes/ketones that are removed in downstream adsorptive guard beds and thereby lower pretreatment unit costs. The sodium bisulfite wash units are known in the art.

A fourth pretreatment zone 18*d* may comprise a water wash unit which may be utilized to remove nitriles and oxygenates in the oligomerization feed stream 12. In the water wash unit, water can be contacted counter-currently against the feed to the water wash unit. The counter-current action of these two streams can result in a spent water stream (not shown), which may contain one or more nitriles and oxygenates, and a stream 26 that is depleted in oxygenates and nitriles. Such water wash units are well known in the art.

Finally, a fifth pretreatment zone 18*e* may comprise a nitrile removal unit which may be utilized to remove nitriles in the treated stream 24. In a nitrile removal unit, a regenerable adsorbent, contained in one or more beds, adsorbs nitriles from the feed to provide a nitrile depleted stream 28. Examples of nitrogen removal units can be found in U.S. Pat. Nos. 4,831,206, 5,120,881 and 5,271,835.

The configuration and design of the purification units 18*a*, 18*b*, 18*c*, 18*d*, 18*e* may be modified and the particulars of each are well within the knowledge of those of ordinary skill in the art.

After passing through the various purification units 18*a*, 18*b*, 18*c*, 18*d*, 18*e*, the oligomerization feed stream 12 is preferably depleted of sulfur containing compounds, diolefins and/or oxygenates and nitriles. However, as mentioned at the outset, cyclo C5/C6 hydrocarbons cannot be efficiently removed from the oligomerization feed stream 12. Thus, the oligomerization feed stream 12 will, in most instances, include the cyclo C5/C6 hydrocarbons even after passing through the various purification units 18*a*, 18*b*, 18*c*, 18*d*, 18*e*. For example, the oligomerization feed stream 12 may comprise from approximately 0.25 to approximately 5 wt %, or from 0.5 to approximately 3 wt % cyclo C5 hydrocarbons. Additionally, the oligomerization feed stream 12 may comprise from approximately 0.25 to approximately 5 wt %, or from 0.5 to approximately 3 wt % cyclo C6 hydrocarbons.

As shown in FIG. 1, the oligomerization feed stream 12 is passed, after passing through the various purification units 18*a*, 18*b*, 18*c*, 18*d*, 18*e*, into the oligomerization zone 10. The oligomerization feed stream 12 may be mixed with a recycle stream 30 comprising a portion of an oligomerized effluent (discussed below) prior to entering the oligomerization zone 10. In an aspect, the recycle stream 30 may be mixed with the oligomerization feed stream 12 to provide a combined feed stream 31 containing approximately 5 to approximately 50 wt % light olefins and suitably approximately 10 to approximately 40 wt % light olefins.

Figure 2:
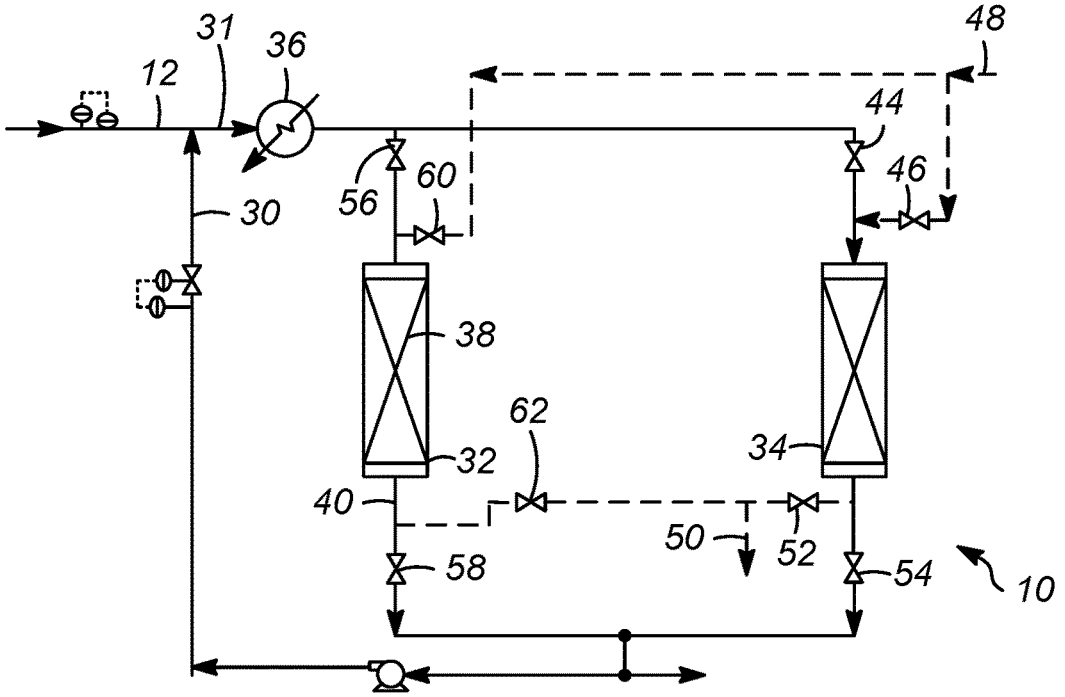
FIG. 2 shows an exemplary oligomerization zone that may be used in accordance with one or more embodiments of the present invention.

Turning to FIG. 2, the oligomerization zone 10 is shown in more detail. More specifically, in an exemplary configuration the oligomerization zone 10 includes two reactors 32, 34. The combined feed stream 31 may be heated in a heater 36 prior to entering the first oligomerization reactor 32. The first oligomerization reactor 32 may comprise one or more catalyst beds 38 containing an oligomerization catalyst capable of oligomerizing the light olefins in the oligomerization feed 12 and providing an oligomerized effluent 40.

Thus, in the oligomerization zone 10, C4 olefins in the oligomerization feed stream 12 oligomerize over the oligomerization catalyst to provide an oligomerate comprising C4 olefin dimers and trimers. The C5 olefins in the oligomerization feed stream 12 oligomerize over the oligomerization catalyst to provide an oligomerate comprising C5 olefin dimers and trimers and co-oligomerize with C4 olefins to make C9 olefins. The oligomerization produces other heavier oligomers with additional carbon numbers. Although not depicted as such, a quench fluid, such as portion of the recycle stream 30 may be used for cooling between catalyst beds to control or limit the temperature rise in the reactor 32. The liquid oligomerate or the oligomerized effluent 40 may also comprise oligomerized olefins that can react with the C4 olefins and C5 olefins in the feed and other oligomerized olefins if present to make diesel range olefins.

The oligomerization catalyst may comprise from 5 and 95 wt % zeolite. Suitable zeolites include zeolites having a structure from one of the following classes: MFI, MEL, ITH, IMF, TUN, FER, BEA, FAU, BPH, MEI, MSE, MWW, UZM-8, MOR, OFF, MTW, TON, MTT, AFO, ATO, and AEL In a preferred aspect, the oligomerization catalyst may comprise a zeolite with a framework having a ten-membered ring pore structure. Examples of suitable zeolites having a ten-membered ring pore structure include TON, MTT, MFI, MEL, AFO, AEL, EUO and FER. In a further preferred aspect, the zeolite having a ten-membered ring pore structure may comprise a uni-dimensional pore structure. A uni-dimensional pore structure indicates zeolites containing non-intersecting pores that are substantially parallel to one of the axes of the crystal. The pores preferably extend through the zeolite crystal. Suitable examples of zeolites having a ten-membered ring uni-dimensional pore structure include MTT. In a further aspect, the oligomerization catalyst comprises an MTT zeolite.

As is known, the oligomerization catalyst may be formed by combining the zeolite with a binder, and then forming the catalyst into pellets. The pellets may optionally be treated with a phosphoric reagent to create a zeolite having a phosphorous component from 0.5 to 15 wt % of the treated catalyst. The binder is used to confer hardness and strength on the catalyst. Binders include alumina, aluminum phosphate, silica, silica-alumina, zirconia, titania and combinations of these metal oxides, and other refractory oxides, and clays such as montmorillonite, kaolin, palygorskite, smectite and attapulgite. A preferred binder is an aluminum-based binder, such as alumina, aluminum phosphate, silica-alumina and clays. The alumina source may be any of the various hydrous aluminum oxides or alumina gels such as alpha-alumina monohydrate of the boehmite or pseudo-boehmite structure, alpha-alumina trihydrate of the gibbsite structure, beta-alumina trihydrate of the bayerite structure, and the like. A suitable alumina is available from UOP LLC under the trademark Versal. A preferred alumina is available from Sasol North America Alumina Product Group under the trademark Catapal. This material is an extremely high purity alpha-alumina monohydrate (pseudo-boehmite) which after calcination at a high temperature has been shown to yield a high purity gamma-alumina.

A suitable oligomerization catalyst may be prepared by mixing proportionate volumes of zeolite and alumina to achieve the desired zeolite-to-alumina ratio. In an embodiment, approximately 5 to approximately 80 wt %, typically approximately 10 to approximately 60 wt %, suitably approximately 15 to approximately 40 wt %, and preferably approximately 20 to approximately 30 wt % MTT zeolite and the balance alumina powder will provide a suitably supported catalyst. A silica support is also contemplated.

Monoprotic acid, such as nitric acid or formic acid, may be added to the mixture in aqueous solution to peptize the alumina in the binder. Additional water may be added to the mixture to provide sufficient wetness to constitute a dough with sufficient consistency to be extruded or spray dried. Extrusion aids such as cellulose ether powders can also be added. A preferred extrusion aid is available from The Dow Chemical Company under the trademark Methocel.

The paste or dough may be prepared in the form of shaped particulates, with the preferred method being to extrude the dough through a die having openings therein of desired size and shape, after which the extruded matter is broken into extrudates of desired length and dried. A further step of calcination may be employed to give added strength to the extrudate. Generally, calcination is conducted in a stream of air at a temperature from approximately 260 to approximately 815° C. (500 to 1,500° F.). The MTT catalyst is not selectivated to neutralize surface acid sites such as with an amine.

The extruded particles may have any suitable cross-sectional shape, i.e., symmetrical or asymmetrical, but most often have a symmetrical cross-sectional shape, preferably a spherical, cylindrical or polylobal shape. The cross-sectional diameter of the particles may be as small as 40 μm; however, it is usually approximately 0.635 mm (0.25 inch) to approximately 12.7 mm (0.5 inch), preferably approximately 0.79 mm (1/32 inch) to approximately 6.35 mm (0.25 inch), and most preferably approximately 0.06 mm (1/24 inch) to approximately 4.23 mm (1/6 inch).

The operating conditions of the oligomerization reactor zone 10 with the oligomerization catalyst are preferably selected to produce a diesel range product at a target product yield of at least 50 wt % of feed light olefins, or at least 65 wt % of feed light olefins, with a target cetane number of at least 35, or in some aspects at least 38, or in some aspects at least 40. Additionally, the target product distillate yield can be at least 10 wt %, or at least 20 wt %, or at least 25 wt %, or at least 30 wt %, or at least 35 wt %, or at least 40 wt %, or at least 45 wt %, or at least 55 wt %, or at least 50 wt %, or at least 70 wt %, or at least 75 wt %, or greater than 75 wt % of feed light olefins.

Exemplary operating pressures include from approximately 2.1 MPa (300 psia) to approximately 10.5 MPa (1,520 psia), suitably at a pressure from approximately 2.1 MPa (300 psia) to approximately 6.9 MPa (1,000 psia) and preferably at a pressure from approximately 2.8 MPa (600 psia) to approximately 4.1 MPa (900 psia). Lower pressures may be suitable if the reaction is kept in the liquid phase.

The temperature of the oligomerization conditions in the oligomerization zone 10, expressed in terms of a peak bed temperature, may be initially at least 210° C. (410° F.), or from 210 and 230° C. (410 and 446° F.), or higher. As mentioned above, the present invention is directed at the controlling the operating of oligomerization zone 10 in order to counteract catalyst deactivation while maintaining product conversion levels and product quality.

Both the cyclo C5/C6 hydrocarbons and sulfur compounds can impact the reactivity of the catalyst; however, the effect of cyclo C5/C6 hydrocarbons and sulfur compounds on the catalyst can be reversed. Applicant's studies have demonstrated that sulfur compounds can be adsorbed on an MTT catalyst with high capacity at low temperature, but the sulfur adsorption is greatly reduced by increasing the reactor temperature. At high temperature, the sulfur species coverage on the catalyst surface may be reduced and lessen the deactivation effect. Additionally, at high temperature, some of these light sulfur species react and convert into components which are more weakly adsorbed and which have less impact on catalyst performance. Based upon experimental results, the same adsorption strength phenomena appears to exist for cyclo C5/C6 hydrocarbons on the MTT catalyst.

However, simply increasing the oligomerization reactor temperature above the minimum temperature required to achieve the target distillate yield and product quality will increase the production of undesired byproducts like aromatics and lower the product quality (cetane number) of the diesel product—thus providing an inferior and lower value product. Additionally, the increased temperature can also increase back cracking (oligomers converting back to light olefins) and increase coke formation. Thus, an undesired consequence of high temperature operation is an increase in byproducts such as aromatics products.

Figure 3:
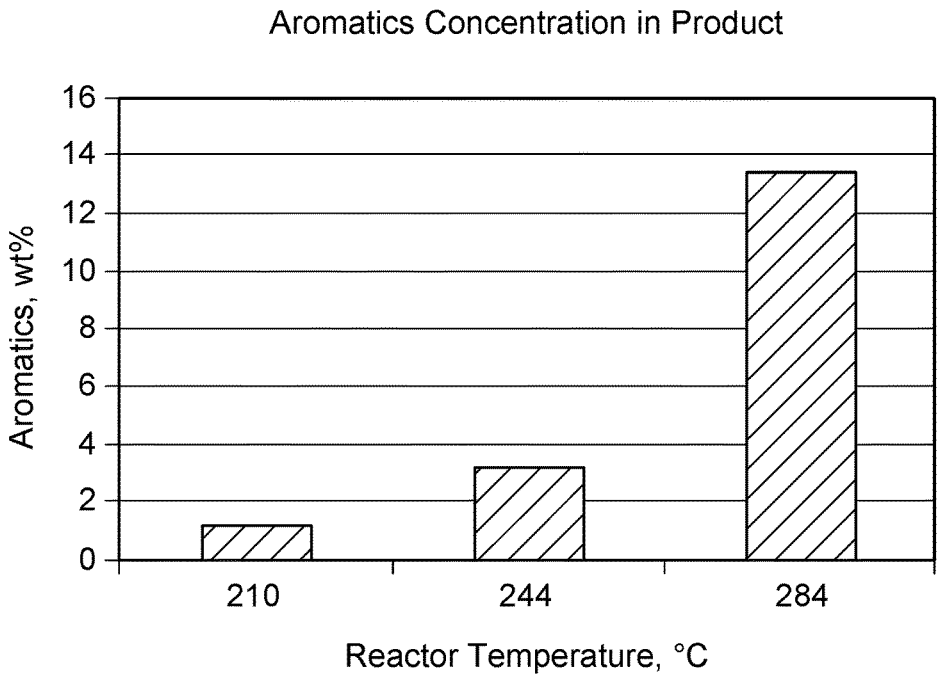
FIG. 3 shows a graphical relationship between the amount of aromatics in an effluent from an oligomerization reaction zone and the reactor temperature of the oligomerization reaction zone.
Figure 4:
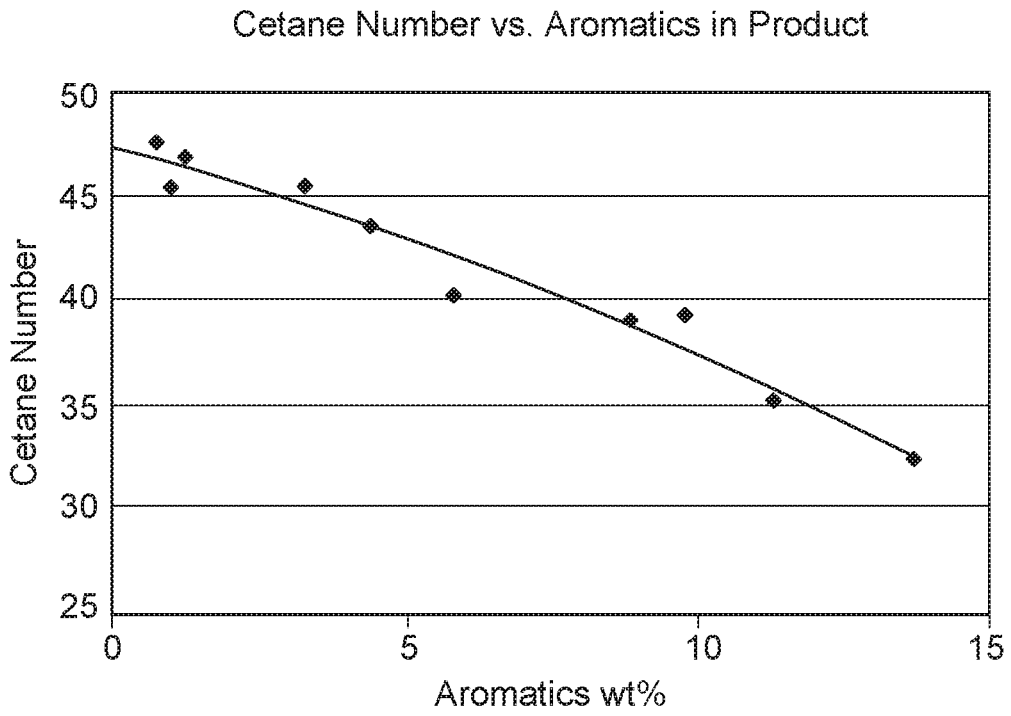
FIG. 4 shows a graphical relationship between the cetane number of a product and the amount of aromatics in same.
Figure 5:
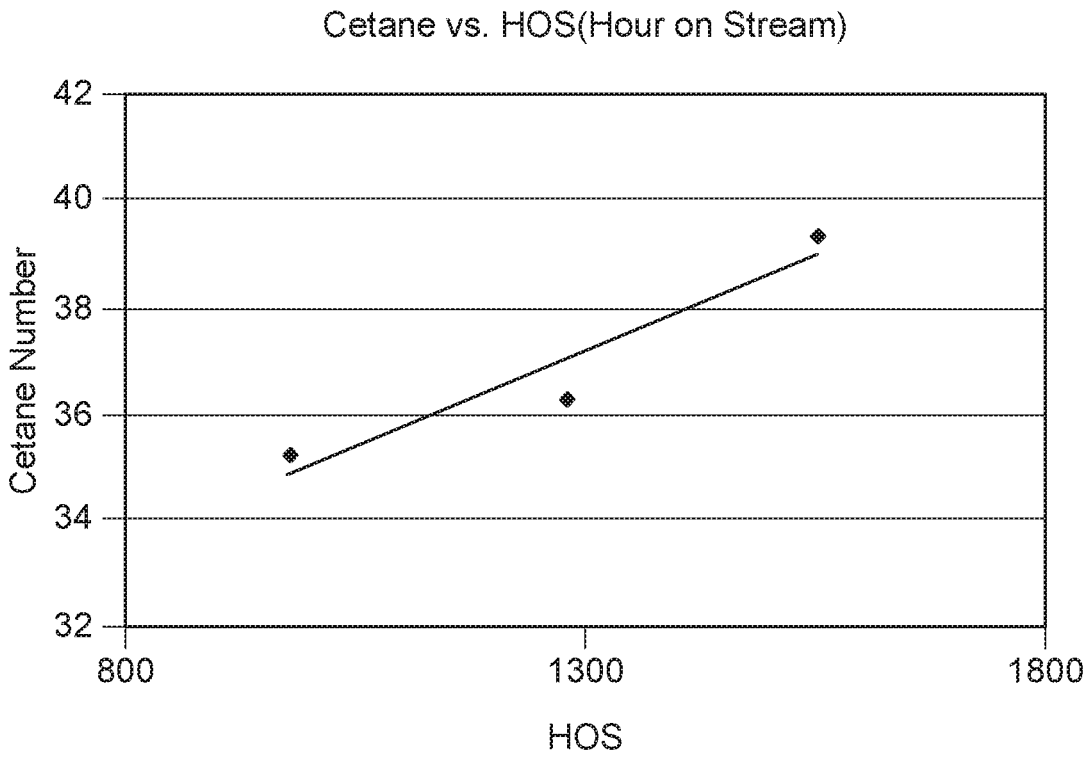
FIG. 5 shows a graphical relationship between the cetane number of a product and the hours on stream of an oligomerization reaction zone; and, FIG. 6 shows a graphical relationship between the conversion of a feed stream (based upon weight percent of feed light olefins) and the hours on stream of an oligomerization catalyst.

As shown in FIG. 3, as the temperature of the oligomerization zone 10 increases, the amount of aromatic byproduct in the oligomerized effluent 40 will increase. As shown in FIG. 4, as the amount of aromatic byproduct increases in the oligomerized effluent 40, the cetane number of the olefinic distillate portion or "cut" of the oligomerized effluent 40 decreases. Thus, an unnecessarily high temperature will result in an increase of byproduct that lowers the product quality. Accordingly, while the oligomerization zone 10 may operate a high olefin conversion level, the oligomerization zone 10 may not be achieving the desired product quality level. Furthermore, as shown in FIG. 5, as catalyst deactivation increases (reflected by an increase in the Hour on Stream), the product quality level, in this case, the cetane number, increases. This indicates that the low number from the unnecessarily high temperature and fresh catalyst increases during catalyst deactivation which leads to the reduction of byproduct reactions. Accordingly, by gradually increasing the temperature of the oligomerization zone 10, it is believed that the catalyst deactivation can be counteracted in a manner that achieves a target product yield with a desired product quality (or cetane number).

According to the processes of the present invention, a catalyst that has been in service for over 100 hours (i.e., with 100 Hours on Stream) may provide a product with less than 12 wt %, or less than 10 wt %, or less than 7 wt % aromatics. Additionally, such results may be achieved with a catalyst that has been in service for 200 hours, 500 hours, or even 1000 hours. This is in contrast to FIG. 3 which indicates that the aromatic portion of the product should increase as the temperature increases.

Preferably, the temperature of the oligomerization zone 10 is increased in increments based upon the feed rate into the oligomerization zone 10. The feed rate to the oligomerization zone 10 preferably has a WHSV from approximately 0.1 to approximately 5.0 $hr^{-1}$, or in at least one embodiment, from approximately 0.1 to 1.5 $hr^{-1}$ and the increments may be from 0 to 10° C. (0.18 and 18° F.) per day.

In at least one embodiment of the process, the product yield level in the oligomerized effluent 40 is monitored or measured to determine if the oligomerization zone 10 is achieving the target product yield level. Additionally and/or alternatively, the olefinic cetane number of the distillate portion of the oligomerized effluent 40 may be measured in order to determine if the oligomerization zone 10 is achieving the target cetane number. If the actual product yield level is at least 2%, or at least 3% or at least 4% or at least 5% or at least 6% or at least 7% below the target product yield level, and if the product cetane number is above the target cetane number, the temperature of the oligomerization zone 10 may be increased. The difference between the actual product yield level and the target product yield level may differ between refineries, and within the same refineries may differ between runs, and during the same run may differ merely based upon the timing and target production level.

If, after increasing the temperature of the oligomerization zone 10, the distillate yield level is still below the target product yield level and the distillate product cetane number is below the target cetane number, the reactor may be removed from service for regeneration of the catalyst and a freshly regenerated reactor may be placed into service without interruption of feed to the oligomerization zone 10. However, this is not always required, depending on the requirements and desired products of the refiner. For example, if needed for a diesel blending component, the reactor may remain in service even though the cetane number of the product is below the target cetane number. It is contemplated that the peak bed temperature for the oligomerization zone 10 may be greater than 260° C. (500° F.), or greater than 280° C. (536° F.), when the reactor is removed from service and the catalyst therein subjected to a regeneration process.

Returning to FIG. 2, the oligomerized effluent 40 may be recovered from the first oligomerization reactor 32, and a portion of same may be used as the recycle stream 30. The oligomerized effluent 40 is preferably rich in diesel range hydrocarbons. By "rich" it is meant that the concentration of diesel range hydrocarbons in the oligomerized effluent 40 is greater than the concentration of diesel hydrocarbons in the oligomerization feed stream 12.

As mentioned above, in at least one embodiment, the oligomerization zone 10 includes the second oligomerization reactor 34 which may be operated in a swing bed fashion to take one reactor offline for maintenance or catalyst regeneration or replacement while the other reactor stays online. Thus, the second oligomerization reactor 34 may also include one or more catalyst beds 38 containing the oligomerization catalyst. When the first oligomerization reactor 32 is online, the second oligomerization reactor 34 may be isolated from the combined feed stream 31 via an inlet valve 44 that is closed. A regenerant valve 46 may be opened to allow the flow of a regenerant stream 48 into the second oligomerization reactor 34. The regeneration conditions may include an oxidative carbon burn step. Variations in regeneration conditions or technique for zeolitic oligomerization catalysts are known in the art. A spent regenerant stream 50, including compounds formed by one or more contaminants that have been removed from the oligomerization catalyst, may be processed further as is known in the art. When the first oligomerization reactor 32 is to be taken offline the regenerant valve 46 and a regenerant outlet valve 52 of the second oligomerization reactor 34 may be closed, while the inlet valve 44 and an outlet value 54 of the second oligomerization reactor 34 may be opened. An inlet valve 56 and an outlet valve 58 of the first oligomerization reactor 32 may be closed, and a regenerant valve 60 and a regenerant outlet valve 62 the first oligomerization reactor 32 may be opened. The regenerant stream 48 will now flow into the first oligomerization reactor 32, while the combined feed stream 31 will be fed into the second oligomerization reactor 34. Such configurations are known to those of ordinary skill in the art. It is also contemplated that the reactors 34 and 32 could be set up in a lead-lag configuration.

Returning to FIG. 1, an oligomerization recovery zone 64 is in downstream communication with the oligomerization zone 10. The oligomerization recovery zone 64 may include a debutanizer column 66 which separates the oligomerized effluent 40 into a first overhead light stream 68 comprising C4 olefins and hydrocarbons and a first liquid oligomerate bottom stream 70 comprising C5+ olefins and hydrocarbons. Suitable operating conditions for the debutanizer column 66 are known in the art.

The oligomerization recovery zone 64 may also include a splitter column 72 to which the first liquid oligomerate bottom stream 70 comprising C5+ olefins and hydrocarbons may be fed for further separation. More specifically, the splitter column 72 separates the first liquid oligomerate bottom stream 70 into a gasoline overhead stream 74 comprising C6, C7, C8, C9, C10 and/or C11 olefins and a bottoms distillate stream 76 comprising C8+, C9+, C10+, C11+, or C12+ olefins. Suitable operating conditions for the splitter column 72 are known in the art. The splitter column 72 design can be adjusted to provide a bottom product (i.e., the bottoms distillate stream 76) between a C9+ olefin cut and a C12+ olefin cut based on the desired boiling range of the distillate product. The diesel bottoms stream in bottoms distillate stream 76 may have greater than 30 wt % C9+ iso-olefins.

Although not depicted as such, the gasoline overhead stream 74 can be recycled to the oligomerization zone 10 to increase the production of distillate. For example, a portion of the gasoline overhead stream 74 may be mixed with the oligomerization feed stream 12. The bottom distillate stream 76 may be recovered as product, may be subjected to further processing such as hydrotreating, may be separated to recover useful components or may be blended in a diesel blending pool.

In order to demonstrate the impact of cyclo C5 hydrocarbons on an MTT catalyst in an oligomerization reaction, a first and second feed stream were passed to an oligomerization reaction zone. Both feed streams comprised 37.15 wt % C4 olefins and 23.81 wt % C5 olefins. Additionally, both streams included C4 and C5 paraffins, at 23.89 wt % and 13.08 wt %, respectively. Finally, both feed streams included additional compounds, with only the second feed stream including approximately 1.3 wt % cyclopentane and cyclopentene. The first feed stream was free of cyclo C5 hydrocarbons.

The temperature of the oligomerization reaction zone was approximately 220° C. (428° F.). The oligomerization reaction zone had an operating pressure of approximately 6.2 MPa (gauge) (900 psig). The feed streams were introduced into the oligomerization reaction zone with a WHSV of 1.5 $hr^{-1}$. Initially, the feed to the oligomerization reaction zone was the first feed stream. Eventually, the feed to the oligomerization reaction zone was switched to the second feed stream. The feed to the oligomerization reaction zone was eventually switched back to the first feed stream. The results and data obtained from this oligomerization are shown in FIG. 6, in which a vertical dashed line at approximately 1125 hours indicates the switch from the first feed stream to the second feed stream, and a vertical dashed line at approximately 1200 hours indicates the switch from the second feed stream back to the first feed stream.

Figure 6:
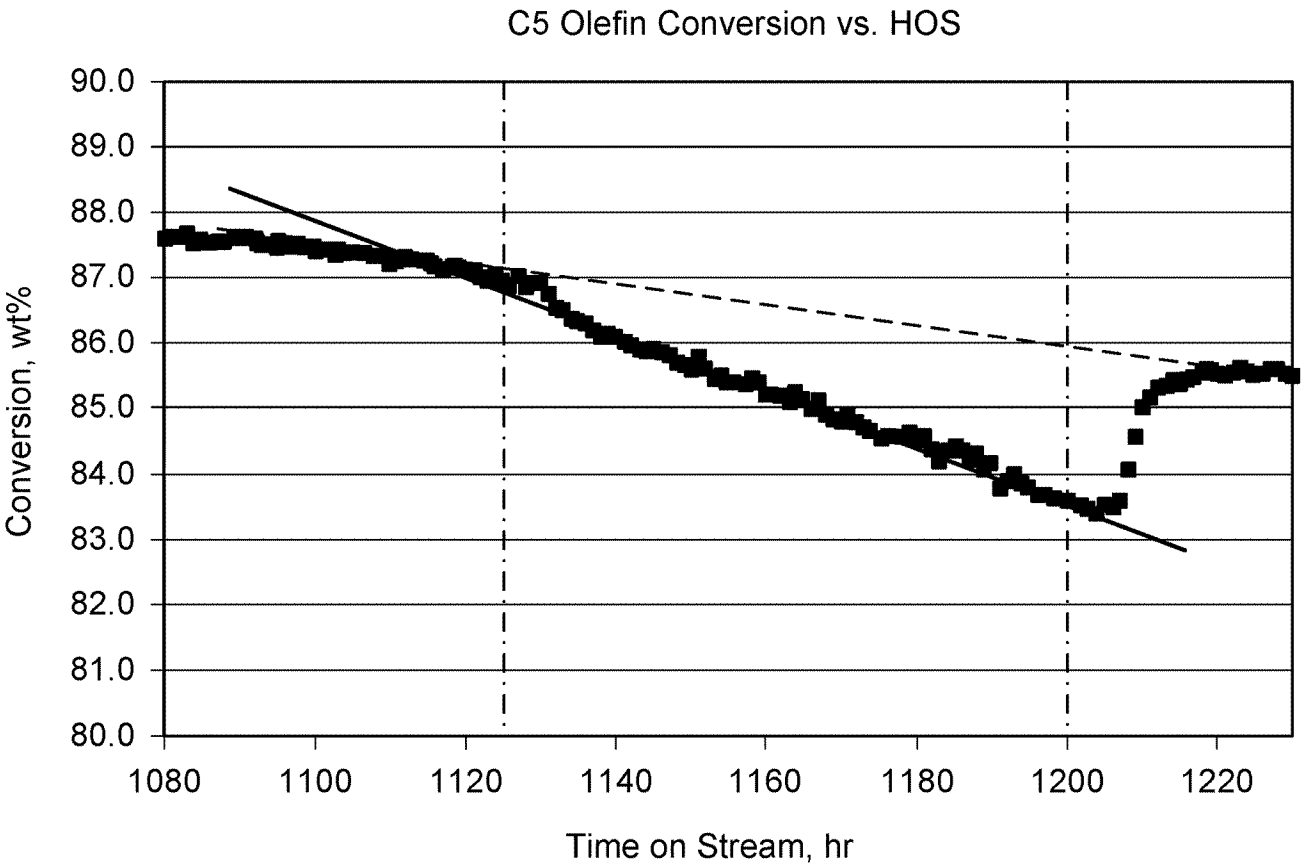

As can be seen in FIG. 6, the conversion levels of the olefins in the first feed stream was slowly lowered over time. This is a result of the deactivation of the catalyst from coke (i.e., coking). When the second feed stream was introduced, the conversion level continued to decreased but at a much greater rate. Additionally, when the feed was switched back to the first feed stream, the conversion levels increased and then returned to a deactivation rate consistent with the initial deactivation rate associated with the initial conversion of the first feed stream. The more rapidly decreasing conversion levels indicate an accelerated catalyst deactivation which is caused by the presence of the cyclo C5 species in the second feed stream. Accordingly, the presence of the cyclo C5 species in a feed stream to an oligomerization reaction zone may result in a more rapid deactivation of oligomerization catalyst—which requires a process, such as one of the processes disclosed herein, to counteract such catalyst deactivation in an efficient and/or effective manner.

As discussed above, the controlled, incremental temperature increase of the oligomerization zone allows for the zone to counteract catalyst deactivation and allow the oligomerization zone to be operated in a manner that can achieve the target production yield and the target product quality for a commercially acceptable operation time.

Preferred embodiments of this invention are described herein, including the best mode known to the inventors for carrying out the invention. It should be understood that the illustrated embodiments are exemplary only, and should not be taken as limiting the scope of the invention.

SPECIFIC EMBODIMENTS

While the following is described in conjunction with specific embodiments, it will be understood that this description is intended to illustrate and not limit the scope of the preceding description and the appended claims.

A first embodiment of the invention is a process for producing a hydrocarbon fuel product, the process comprising operating an oligomerization reaction zone to achieve a diesel range product at a target product distillate yield with a target product cetane number of at least 35, wherein the oligomerization zone receives a oligomerization feed stream comprising C4 and C5 olefins and includes a catalyst with a ten-membered ring pore structure and being configured to selectively oligomerize the olefins and provide a oligomerized effluent rich in diesel range hydrocarbons; deactivating the catalyst by coking, by exposing the catalyst to contaminants including at least cyclo C5 hydrocarbons, or by a combination thereof to a predetermined degree such that a product distillate yield of the oligomerization reaction zone is reduced at least 2% less than the target product distillate yield; increasing a peak bed temperature of the oligomerization reaction zone in response to the deactivation of the catalyst, in order to achieve both the target product distillate yield and the target product cetane number; and, regenerating the catalyst after the peak bed temperature of the oligomerization reaction zone has been increased if the target product distillate yield and the target product cetane number are not achieved. An embodiment of the invention is one, any or all of prior embodiments in this paragraph up through the first embodiment in this paragraph wherein the peak bed temperature of the oligomerization reaction zone is repeatedly increased as long as the oligomerization reaction zone is operated to achieve the target product cetane number of at least 35. An embodiment of the invention is one, any or all of prior embodiments in this paragraph up through the first embodiment in this paragraph wherein, the oligomerization reaction zone is initially operated with a peak bed temperature from approximately 210 to approximately 230° C. An embodiment of the invention is one, any or all of prior embodiments in this paragraph up through the first embodiment in this paragraph wherein the temperature of the oligomerization reaction zone is increased in increments from approximately 0 to approximately 10° C. per day based upon a feed rate to the oligomerization zone. An embodiment of the invention is one, any or all of prior embodiments in this paragraph up through the first embodiment in this paragraph wherein the oligomerization reaction zone has been operated for a time of at least 100 hours and wherein the oligomerized effluent comprises less than 12 wt % aromatics. An embodiment of the invention is one, any or all of prior embodiments in this paragraph up through the first embodiment in this paragraph wherein the target product distillate yield is greater than 50 wt % of feed light olefins. An embodiment of the invention is one, any or all of prior embodiments in this paragraph up through the first embodiment in this paragraph wherein the target product distillate yield is greater than 65 wt % feed light olefins and the target product cetane number is at least 38. An embodiment of the invention is one, any or all of prior embodiments in this paragraph up through the first embodiment in this paragraph wherein the target product cetane number is at least 40. An embodiment of the invention is one, any or all of prior embodiments in this paragraph up through the first embodiment in this paragraph further comprising monitoring a distillate product yield level of the oligomerized effluent to determine if the oligomerization reaction zone is achieving the target distillate product yield; and, monitoring a cetane number of a portion of the oligomerized effluent to determine if the oligomerization reaction zone is achieving the target product cetane number. An embodiment of the invention is one, any or all of prior embodiments in this paragraph up through the first embodiment in this paragraph further comprising reducing a feed rate of the oligomerization feed stream in response to the deactivation of the catalyst to the predetermined degree by at least the cyclo C5/C6 hydrocarbons. An embodiment of the invention is one, any or all of prior embodiments in this paragraph up through the first embodiment in this paragraph further comprising combining a portion of the oligomerized effluent with the oligomerization feed stream.

A second embodiment of the invention is a process for producing a hydrocarbon fuel product, the process comprising separating a cracked effluent stream into at least an oligomerization feed stream comprising at least C4 and C5 olefins, wherein the oligomerization feed stream includes one or more of sulfur contaminants; cyclo C5/C6 hydrocarbons; or, nitriles; passing the oligomerization feed stream to an oligomerization reaction zone, the oligomerization reaction zone including a catalyst with a ten-membered ring pore structure configured to selectively oligomerize the olefins and provide a oligomerized effluent being rich in diesel range hydrocarbons, wherein a peak bed temperature of the oligomerization reaction zone is initially approximately 210° C. when the oligomerization feed stream is first passed into the oligomerization reaction zone; and, increasing the peak bed temperature of the oligomerization reaction zone to maintain a target distillate product yield level of at least 50 wt % feed light olefins and a target product cetane number of at least 35. An embodiment of the invention is one, any or all of prior embodiments in this paragraph up through the second embodiment in this paragraph wherein the peak bed temperature is increased in increments from approximately 0.1 to approximately 10° C. per day based upon a feed rate into the oligomerization zone and wherein a feed rate of the oligomerization feed stream is from approximately 0.1 to 1.5 WHSV. An embodiment of the invention is one, any or all of prior embodiments in this paragraph up through the second embodiment in this paragraph wherein the target distillate product yield level is at approximately 65 wt % feed light olefins and the target product cetane number is at least 38. An embodiment of the invention is one, any or all of prior embodiments in this paragraph up through the second embodiment in this paragraph wherein the target product cetane number is at least 40. An embodiment of the invention is one, any or all of prior embodiments in this paragraph up through the second embodiment in this paragraph further comprising combining a portion of the oligomerized effluent with the oligomerization feed stream. An embodiment of the invention is one, any or all of prior embodiments in this paragraph up through the second embodiment in this paragraph further comprising monitoring a distillate product yield level in the oligomerized effluent to determine if the oligomerization reaction zone is achieving the target distillate product yield level; monitoring a cetane number of a portion of the oligomerized effluent to determine if the oligomerization reaction zone is achieving the target product cetane number; and, increasing the peak bed temperature of the oligomerization reaction zone if the distillate product yield level is below the target distillate product yield level and if the product cetane number is above the target cetane number. An embodiment of the invention is one, any or all of prior embodiments in this paragraph up through the second embodiment in this paragraph further comprising counteracting a deactivation of the catalyst from at least cyclo C5/C6 hydrocarbons by gradually increasing the peak bed temperature of the oligomerization reaction zone.

A third embodiment of the invention is a process for producing a hydrocarbon fuel product, the process comprising passing a portion of a cracked effluent stream to a purification unit configured to provide an oligomerization feed stream comprising at least C4 and C5 olefins and one or more of sulfur contaminants, cyclo C5/C6 hydrocarbons, and, nitriles; passing the oligomerization feed stream to a first reactor in an oligomerization reaction zone, the oligomerization reaction zone comprising at least two reactors, each including a catalyst with a ten-membered ring pore structure configured to selectively oligomerize the olefins and provide a oligomerized effluent being rich in diesel range hydrocarbons; measuring a distillate product yield level of the oligomerized effluent from the first reactor in the oligomerization reaction zone to determine if the first reactor in the oligomerization reaction zone is achieving a target product yield level comprising at least 50 wt % of feed light olefins; measuring a cetane number of a portion of the oligomerized effluent from the first reactor in the oligomerization reaction zone to determine if the first reactor in the oligomerization reaction zone is achieving a target cetane number comprising at least 35; increasing a peak bed temperature of the first reactor in the oligomerization reaction zone if the distillate product yield level of the oligomerized effluent from the first reactor in the oligomerization reaction zone is below the target product yield level and if the cetane number of the portion of the oligomerized effluent from the first reactor in the oligomerization reaction zone is above the target cetane number; removing the first reactor in the oligomerization reaction zone from service if first reactor in the oligomerization reaction zone is not achieving both the target product yield level and the target cetane number; and, regenerating the catalyst in the first reactor after the first reactor has been removed from service. An embodiment of the invention is one, any or all of prior embodiments in this paragraph up through the third embodiment in this paragraph further comprising passing the oligomerization feed stream to a second reactor in the oligomerization reaction zone; measuring a distillate product yield level in the oligomerized effluent from the second reactor in the oligomerization reaction zone to determine if the second reactor in the oligomerization reaction zone is achieving a target product yield level comprising at least 50 wt % of feed light olefins; measuring a cetane number of a portion of the oligomerized effluent from the second reactor in the oligomerization reaction zone to determine if the second reactor in the oligomerization reaction zone is achieving a target cetane number comprising at least 35; and, increasing a peak bed temperature of the second reactor in the oligomerization reaction zone if the distillate product yield level of the oligomerized effluent from the second reactor in the oligomerization reaction zone is below the target product yield level and if the cetane number of the portion of the oligomerized effluent from the second reactor in the oligomerization reaction zone is above the target cetane number.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for producing a hydrocarbon fuel product rich in diesel range hydrocarbons from an oligomerized effluent, the process comprising:

operating an oligomerization reaction zone to achieve a diesel range product at a target product distillate yield with a target product cetane number of at least 35, wherein the oligomerization reaction zone receives an oligomerization feed stream comprising C4 and C5 olefins and includes a catalyst with a ten-membered ring pore structure and is configured to selectively oligomerize the C4 and C5 olefins and provides an oligomerized effluent rich in diesel range hydrocarbons, wherein the oligomerization reaction zone is initially operated with a peak bed temperature from approximately 210° C. to approximately 230° C., and wherein the temperature of the oligomerization reaction zone is increased in increments of up to approximately 10° C. per day based upon a feed rate to the oligomerization reaction zone;

deactivating the catalyst by exposing the catalyst to contaminants comprising cyclo C5 hydrocarbons to a predetermined degree such that a product distillate yield of the oligomerization reaction zone is reduced at least 2% less than the target product distillate yield;

increasing a peak bed temperature of the oligomerization reaction zone in response to the deactivation of the catalyst to the predetermined degree, in order to achieve both the target product distillate yield and the target product cetane number; and regenerating the catalyst after the peak bed temperature of the oligomerization reaction zone has been increased when the target product distillate yield and the target product cetane number are not achieved, wherein the oligomerization feed stream comprises from approximately 0.5 to approximately 5 wt % cyclo C5 hydrocarbons.

2. The process of claim 1 wherein the peak bed temperature of the oligomerization reaction zone is repeatedly increased.

3. The process of claim 1 wherein the oligomerization reaction zone is operated for a time of at least 100 hours and wherein the oligomerized effluent comprises less than 12 wt % aromatics.

4. The process of claim 1 wherein the target product distillate yield is at least greater than 50 wt % of the C4 and C5 olefins in the oligomerization feed stream.

5. The process of claim 1 wherein the target product distillate yield is at least greater than 65 wt % the C4 and C5 olefins in the oligomerization feed stream and the target product cetane number is at least 38.

6. The process of claim 1 wherein the target product cetane number is at least 40.

7. The process of claim 1 further comprising:

monitoring a distillate product yield level of the oligomerized effluent to determine if the oligomerization reaction zone is achieving the target distillate product yield; and, monitoring a cetane number of a portion of the oligomerized effluent to determine if the oligomerization reaction zone is achieving the target product cetane number.

8. The process of claim 1 further comprising:

reducing a feed rate of the oligomerization feed stream in response to the deactivation of the catalyst to the predetermined degree by coking, by at least the cyclo C5 hydrocarbons, or by a combination thereof.

9. The process of claim 1 further comprising:

combining a portion of the oligomerized effluent with the oligomerization feed stream.

10. A process for producing a hydrocarbon fuel product rich in diesel range hydrocarbons from an oligomerized effluent, the process comprising:

separating a cracked effluent stream into at least an oligomerization feed stream comprising light olefins including at least C4 and C5 olefins, wherein the oligomerization feed stream includes one or more of: sulfur contaminants, cyclo C5 hydrocarbons, or, nitriles;

passing the oligomerization feed stream to an oligomerization reaction zone, the oligomerization reaction zone including a catalyst with a ten-membered ring pore structure configured to selectively oligomerize the olefins and provides an oligomerized effluent rich in diesel range hydrocarbons, wherein a peak bed temperature of the oligomerization reaction zone is initially at least approximately 210° C. when the oligomerization feed stream is first passed into the oligomerization reaction zone; and, increasing the peak bed temperature of the oligomerization reaction zone to maintain a target product distillate yield level of at least 50 wt % of the C4 and C5 olefins in the oligomerization feed stream and a target product cetane number of at least 35, wherein the oligomerization feed stream comprises from approximately 0.5 to approximately 5 wt % cyclo C5 hydrocarbons.

11. The process of claim 10 wherein the peak bed temperature is increased in increments from approximately 0.1 to approximately 10° C. per day based upon a feed rate into the oligomerization reaction zone and wherein a feed rate of the oligomerization feed stream corresponds to a WHSV of from approximately 0.1 to 1.5 $hr^{-1}$.

12. The process of claim 10 wherein the target product distillate yield level is at approximately 65 wt % of the light olefins in the oligomerization feed stream and the target product cetane number is at least 38.

13. The process of claim 10 wherein the target product cetane number is at least 40.

14. The process of claim 10 further comprising:

combining a portion of the oligomerized effluent with the oligomerization feed stream.

15. The process of claim 10 further comprising:

monitoring a distillate product yield level in the oligomerized effluent to determine if the oligomerization reaction zone is achieving the target product distillate yield level;

monitoring a cetane number of a portion of the oligomerized effluent to determine if the oligomerization reaction zone is achieving the cetane number of the portion of the oligomerized effluent; and, increasing the peak bed temperature of the oligomerization reaction zone when the distillate product yield level is below the target product distillate yield level and when the product cetane number is above the target product cetane number.

16. The process of claim 10 further comprising:

counteracting a deactivation of the catalyst from at least cyclo C5 hydrocarbons by gradually increasing the peak bed temperature of the oligomerization reaction zone.

17. A process for producing a hydrocarbon fuel product rich in diesel range hydrocarbons from an oligomerized effluent, the process comprising:

passing a portion of a cracked effluent stream to a purification unit configured to provide an oligomerization feed stream comprising at least C4 and C5 olefins and one or more of sulfur contaminants, cyclo C5 hydrocarbons, and nitriles;

passing the oligomerization feed stream to a first reactor in an oligomerization reaction zone, the oligomerization reaction zone comprising a first reactor including a catalyst with a ten-membered ring pore structure configured to selectively oligomerize the olefins and provides an oligomerized effluent rich in diesel range hydrocarbons;

measuring a distillate product yield level of the oligomerized effluent from the first reactor in the oligomerization reaction zone to determine if the first reactor in the oligomerization reaction zone is achieving a target product yield level of at least 50 wt % of the C4 and C5 olefins in the oligomerization feed stream;

measuring a cetane number of a portion of the oligomerized effluent from the first reactor in the oligomerization reaction zone to determine if the first reactor in the oligomerization reaction zone is achieving a target cetane number of at least 35;

increasing a peak bed temperature of the first reactor in the oligomerization reaction zone when the distillate product yield level of the oligomerized effluent from the first reactor in the oligomerization reaction zone is below the target product yield level and when the cetane number of the portion of the oligomerized effluent from the first reactor in the oligomerization reaction zone is above the target cetane number;

removing the first reactor in the oligomerization reaction zone from service when the first reactor in the oligomerization reaction zone is not achieving both the target product yield level and the target cetane number; and, regenerating the catalyst in the first reactor after the first reactor has been removed from service, wherein the oligomerization feed stream comprises from approximately 0.5 to approximately 5 wt % cyclo C5 hydrocarbons.

18. The process of claim 17 further comprising:

passing the oligomerization feed stream to a second reactor in the oligomerization reaction zone, when the first reactor has been removed from service;

measuring a distillate product yield level in the oligomerized effluent from the second reactor in the oligomerization reaction zone to determine if the second reactor in the oligomerization reaction zone is achieving a target product yield level of at least 50 wt % of the C4 and C5 olefins in the oligomerization feed stream;

measuring a cetane number of a portion of the oligomerized effluent from the second reactor in the oligomerization reaction zone to determine if the second reactor in the oligomerization reaction zone is achieving a target cetane number of at least 35; and, increasing a peak bed temperature of the second reactor in the oligomerization reaction zone when the distillate product yield level of the oligomerized effluent from the second reactor in the oligomerization reaction zone is below the target product yield level and when the cetane number of the portion of the oligomerized effluent from the second reactor in the oligomerization reaction zone is above the target cetane number.

* * * * *